US009732757B2

(12) United States Patent
Lee

(10) Patent No.: US 9,732,757 B2
(45) Date of Patent: Aug. 15, 2017

(54) THIN FAN AND MANUFACTURING METHOD THEREOF

(75) Inventor: Chin-Hung Lee, Taoyuan-Hsien (TW)

(73) Assignee: DELTA ELECTRONICS, INC., Taoyuan Hsien (TW)

( * ) Notice: Subject to any disclaimer, the term of this patent is extended or adjusted under 35 U.S.C. 154(b) by 757 days.

(21) Appl. No.: 13/618,145

(22) Filed: Sep. 14, 2012

(65) Prior Publication Data

US 2013/0121830 A1 May 16, 2013

(30) Foreign Application Priority Data

Nov. 10, 2011 (TW) ..... 100140983 A

(51) Int. Cl.
*F04D 29/05* (2006.01)
*F04D 25/06* (2006.01)
*F04D 29/64* (2006.01)

(52) U.S. Cl.
CPC ..... *F04D 25/0653* (2013.01); *F04D 29/646* (2013.01); *Y10T 29/49332* (2015.01)

(58) Field of Classification Search
CPC ..... F04D 29/02; F04D 29/023
See application file for complete search history.

(56) References Cited

U.S. PATENT DOCUMENTS 4,564,335 A * 1/1986 Harmsen ..... F04D 19/002 415/218.1
6,343,915 B2 2/2002 Williams et al.
6,832,646 B1 * 12/2004 Uomori et al. ..... 165/80.2
7,004,726 B2 2/2006 Kuo
7,063,504 B2 6/2006 Huang et al.
7,207,774 B2 * 4/2007 Kashiwazaki et al. ..... 415/206
7,553,136 B2 * 6/2009 Ku ..... F04D 25/066 310/156.32
7,688,589 B2 * 3/2010 Chiang ..... F04D 29/00 165/104.28
7,887,290 B2 2/2011 Chen et al.
(Continued)

FOREIGN PATENT DOCUMENTS

CN 2456211 Y 10/2001
CN 101446294 A 6/2009
(Continued)

OTHER PUBLICATIONS

First and Second Office Actions for Taiwanese Application No. 100140983; Date of Mailing May 15, 2013 and Dec. 19, 2014:, with English Summary.

*Primary Examiner* — Justin Seabe
(74) *Attorney, Agent, or Firm* — Cantor Colburn LLP

(57) ABSTRACT

A thin fan and a manufacturing method thereof are provided. The thin fan has a fan frame, a sleeve, a bearing, an impeller, a magnetic element and at least one coil. The fan frame includes a base and a cover connected to the base. The fan frame has an inlet and an outlet. The sleeve is disposed on the base, and the bearing is disposed within the sleeve. The impeller and the magnetic element are disposed on the fan frame and a metal housing, respectively. The coil is disposed opposite the magnetic element. The base has at least one plastic portion and at least one metal portion. The metal portion has at least one non-magnetic metal, and the plastic portion is integrated with the non-magnetic metal by injection molding.

22 Claims, 9 Drawing Sheets

(56) References Cited

U.S. PATENT DOCUMENTS

| | | | | |
|---|---|---|---|---|
| 8,690,552 | B2 * | 4/2014 | Chang et al. | 417/423.7 |
| 2007/0212219 | A1 * | 9/2007 | Teshima et al. | 415/206 |
| 2009/0169377 | A1 * | 7/2009 | Horng | 415/213.1 |
| 2009/0230798 | A1 | 9/2009 | Ho | |
| 2010/0129235 | A1 | 5/2010 | Qian | |
| 2010/0243218 | A1 * | 9/2010 | Horng et al. | 165/121 |
| 2011/0033300 | A1 * | 2/2011 | Li | 416/174 |
| 2011/0236211 | A1 * | 9/2011 | Schneider | F04D 29/662<br>416/144 |

FOREIGN PATENT DOCUMENTS

| | | | |
|---|---|---|---|
| CN | 201363316 | Y | 12/2009 |
| CN | 201574978 | U | 9/2010 |
| TW | 377054 | | 12/1999 |
| TW | 402668 | B | 8/2000 |
| TW | 534532 | U | 5/2003 |
| TW | 553322 | U | 9/2003 |
| TW | M322140 | U | 11/2007 |
| TW | 200925842 | A | 6/2009 |
| TW | 200944112 | A | 10/2009 |
| TW | I332058 | B | 10/2010 |
| TW | 201038826 | A1 | 12/2010 |
| TW | 201113436 | A | 4/2011 |
| WO | WO 2011154210 | A2 * | 12/2011 |

* cited by examiner

THIN FAN AND MANUFACTURING METHOD THEREOF

This application claims priority to Taiwan Patent Application No. 100140983 filed on Nov. 10, 2011.

CROSS-REFERENCES TO RELATED APPLICATIONS

Not applicable.

BACKGROUND OF THE INVENTION

Field of the Invention

The present invention relates to a thin fan, and more particularly, to a thin fan having a high structural strength and a low motor resonance noise.

Descriptions of the Related Art

With the advancement of science and technologies and the rapid development of manufacturing processes, many consumer electronic products have evolved towards good portability and a light weight to meet the demands of modern consumers. Therefore, along with portable products such as notebook computers, mobile phones and MP3 players, electronic products that conventionally have a bulky volume and poor portability such as projectors and head-mounted displays (HMDs) have also appeared in the market with a lighter and thinner form.

To meet the demands for portable and lightweight products, various kinds of parts and components used in such products must be miniaturized correspondingly to be installed therein. Although these parts and components are further reduced in volume, their performance shall not be compromised but shall be subjected to stricter requirements. A concern is that with insufficient inner space and poor heat dissipating efficiency, the thermolysis of the parts and components is significantly affected, thereby, affecting the performance of these products and also shortening the service life of the products.

Therefore, the practice of disposing a thin fan to actively dissipate the heat has been gradually adopted in the art. However, general centrifugal fans that are currently widely used in notebook computers have an overall height that ranges from about 8 millimeters (mm) to 10 mm, so they have become inapplicable to thin electronic products such as tablet personal computers (PCs), smart mobile phones or ultrathin notebook computers, which are often made to have a thickness less than 9 mm. In consideration of the thickness of the housing and preserved gap for air intake, the overall height of a fan for such a thin electronic product must be made to be less than 4 mm so that the fan can be installed and used successfully in the electronic product. However, making such a thin fan is difficult in the design of moulds, selection of materials, manufacturing, assembling and arrangement of parts.

For example, the joining surface between a shaft and an impeller is reduced because of the reduced height of the fan. To have a firmly joined the shaft and the impeller, a conventional thin fan as disclosed in Taiwan Patent Application No. 94140896 has a shaft and an impeller joined by an assembling element. However, the use of additional assembling elements increases the cost and the overall height of the fan because the assembling element extends above the impeller. In addition, this structure is formed by a plate through punching and bending and if the blades can only extend in a direction towards the annular plate, the height of the blades is limited. As a result, the heat dissipating effect of the air flow driven by the rotating blades is also quite limited.

In another example, a thin fan as disclosed in Taiwan Patent Application No. 94140897 has a shaft joined through an assembling hole formed in both the impeller and the sheet magnet. However, the sheet magnet of this structure extends above the tubular shaft, so the height of the tubular shaft will be reduced because of the sheet magnet. The reduced height of the tubular shaft makes it necessary to use a short bearing. Since the bearing contains a reduced amount of lubricant, the lubricant tends to dry off. This may cause direct friction between the shaft and the bearing and significantly reduce the service life of the bearing.

As a further example, a thin fan as disclosed in Taiwan Patent No. 1299771 has a shaft joined through a spindle seat. However, the spindle seat, which is disposed above a tubular shaft, also reduces the height of the tubular shaft. Consequently, the bearing contains a reduced amount of lubricant, so it has a shortened service life. Moreover, the blades of this structure can only be disposed in the periphery of the spindle seat and above a magnet, so the height of the blades is limited, which affects the heat dissipating effect.

SUMMARY OF THE INVENTION

In view of the aforesaid problems, an objective of the present invention is to provide a thin fan having a height less than 4 mm, which is used for heat dissipation in a thin electronic product.

To achieve the aforesaid objective, the present invention provides a thin fan, which has a fan frame, a sleeve, a bearing, an impeller, a magnetic element and at least one coil. The fan frame is formed by a base and a cover in combination, and comprises an inlet and an outlet. The sleeve is disposed on the base, the bearing is disposed within the sleeve, and the impeller is disposed within the fan frame. The impeller comprises a metal housing, a joining portion, a plurality of blades and a shaft. The metal housing has a first surface and a second surface opposite the first surface in an axial direction, and is formed with an opening extending through the first surface and the second surface. The joining portion is injection molded with the metal housing; and the plurality of blades are integrated with the joining portion by injection molding and disposed around a periphery of the joining portion. The shaft passes through the bearing and extends into the opening, and the shaft is welded with the metal housing at a position where the opening adjoins the first surface. Furthermore, the magnetic element is disposed within the metal housing; and the at least one coil is disposed corresponding to the magnetic element in the axial direction.

According to the concept of the present invention, a laser radiates the position where the opening adjoins the first surface to fuse and weld a surface of the metal housing and a surface of the shaft with each other; the metal housing and the shaft have melting points close to each other; and the material of the metal housing or the shaft is SUS430 or SUS420.

According to the concept of the present invention, the metal housing comprises a convex portion and an extended portion around the convex portion, the joining portion is integrated with the plurality of blades by injection molding at a periphery of the extended portion, and the joining portion and at least a part of the plurality of blades extend to an upper edge of the extended portion. At least one gap exists between the joining portion and the convex portion, and the gap is filled with a balance material.

According to the concept of the present invention, the metal housing has a disc shape, one end of the joining portion is connected to a periphery of the metal housing and the other end is connected to the plurality of blades.

According to the concept of the present invention, the first surface corresponds to the direction of the inlet and the second surface corresponds to the direction of the sleeve; and the second surface has an annular recess that is filled with an oil repellent agent.

According to the concept of the present invention, the base further comprises at least one plastic portion and at least one metal portion; and the metal portion comprises at least one non-magnetic metal and the plastic portion is integrated with the non-magnetic metal by injection molding.

To achieve the aforesaid objective, the present invention provides a thin fan, which has a fan frame, a sleeve, a bearing, an impeller, a magnetic element and at least one coil. The fan frame has a base and a cover connected to the base, and comprises an inlet and an outlet. The sleeve is disposed on the base, the bearing is disposed within the sleeve, and the impeller is disposed within the fan frame. The impeller comprises a metal housing and a plurality of blades. The magnetic element is disposed within the metal housing. The at least one coil is disposed corresponding to the magnetic element. The base further comprises at least one plastic portion and at least one metal portion, the metal portion comprises at least one non-magnetic metal, and the plastic portion is integrated with the non-magnetic metal by injection molding.

According to the concept of the present invention, the plastic portion covers a lower surface of the non-magnetic metal to constitute a bottom of the base, and a ratio of a thickness of the plastic portion to a thickness of the non-magnetic metal is between 1:1 and 1:4. The plastic portion comprises at least one protruding portion extending into the coil to position the coil. The non-magnetic metal comprises at least one positioning hole which allows the protruding portion to pass therethrough.

According to the concept of the present invention, the bottom of the base is formed by the non-magnetic metal, and at least a part of the plastic portion is disposed at a periphery of the non-magnetic metal.

According to the concept of the present invention, the metal portion further comprises at least one magnetic metal for producing a magnetic force with the magnetic element; and the plastic portion comprises at least one recess for embedding the at least one magnetic metal therein.

According to the concept of the present invention, the material of the sleeve is plastic, and the sleeve and the plastic portion of the base are integrated with the non-magnetic metal by injection molding.

According to the concept of the present invention, the non-magnetic metal of the base comprises a through hole for positioning the sleeve. The sleeve is a metal sleeve, and the non-magnetic metal around the through hole comprises a ring-shaped protrusion which clips to the metal sleeve directly; the non-magnetic metal around the through hole comprises a ring-shaped protrusion, and the ring-shaped protrusion and the metal sleeve are integrated by the plastic portion or, a laser radiates a periphery of the through hole to fuse and weld a surface of the metal sleeve and a surface of the non-magnetic metal with each other.

According to the concept of the present invention, the thin fan further comprises an isolation layer directly formed on the surface of the non-magnetic metal; and the isolation layer is formed on the surface of the non-magnetic metal through electrophoresis or electroplating.

According to the concept of the present invention, the at least one coil is disposed on a surface of the isolation layer.

According to the concept of the present invention, the cover comprises a top wall and at least one side wall surrounding the top wall, the inlet is disposed on the top wall and the outlet is disposed on the side wall. A center of the inlet and a center of the top wall of the cover are not overlapping. The center of the inlet is biased towards the direction of the outlet. The cover further comprises at least one flow channel structure that extends from the top wall towards the base, and the flow channel structure is disposed at a periphery of the impeller. The base comprises at least one convex portion extending in the axial direction, the cover comprises at least one slot corresponding to the convex portion, and the base and the cover are combined together via the convex portion embedded in the slot. The slot is formed on the flow channel structure. The base comprises at least one snap, and the cover comprises at least one aperture corresponding to the snap.

According to the concept of the present invention, each of the blades further comprises a notch, which comprises a side edge and a lower edge, the lower edge extends under the top wall of the cover, and the side edge extends into the inlet to prevent the impeller from falling off the inlet.

According to the concept of the present invention, the thin fan further comprises a flexible substrate and a flat cable extending in a plate form. The flexible substrate is disposed between the base and the coil, and a surface of the flexible substrate comprises an isolation layer, which has a coil disposed therein. One end of the flat cable connects the flexible substrate and the other end comprises a finger structure.

According to the concept of the present invention, the magnetic element and the coil are disposed corresponding to each other in the axial direction. The magnetic element is flat ring-shaped and is attached to the lower edge of the metal housing.

According to the concept of the present invention, the material of the magnetic element is preferred to be Rubidium Iron Boron; the material of the non-magnetic metal is preferred to be SUS301 or SUS304; and the material of the magnetic metal is preferred to be silicon steel.

According to the concept of the present invention, a height of the fan frame is less than 4 mm, and a height of the sleeve is larger than 75% of the height of the fan frame.

To achieve the aforesaid objective, the present invention provides a manufacturing method of a thin fan, which comprises the following steps:

providing a metal housing, wherein the metal housing comprises a first surface and a second surface opposite the first surface in an axial direction, and is formed with an opening extending through the first surface and the second surface;

providing a shaft for passing through the opening;

welding the shaft with the metal housing at a position where the opening adjoins the first surface;

having a joining portion and a plurality of blades integrated with the metal housing by injection molding;

positioning a magnetic element on the metal housing;

forming a base;

providing a sleeve disposed on the base, wherein the sleeve comprises a bearing;

positioning at least one coil on the base; and passing the shaft through the bearing so that the magnetic element is disposed opposite the coil in the axial direction.

According to the concept of the present invention, the step of welding the shaft with the metal housing at a position where the opening adjoins the first surface further comprises: radiating the position where the opening adjoins the first surface by a laser, so as to fuse and weld a surface of the metal housing and a surface of the shaft with each other.

According to the concept of the present invention, the step of forming the base further comprises: providing at least one non-magnetic metal; and integrating at least one plastic portion with the non-magnetic metal by injection molding.

According to the concept of the present invention, the manufacturing method further comprises a step of attaching a magnetic metal on the plastic portion or the non-magnetic metal.

The detailed technology and preferred embodiments implemented for the subject invention are described in the following paragraphs accompanying the appended drawings for people skilled in this field to well appreciate the features of the claimed invention.

DESCRIPTION OF THE PREFERRED EMBODIMENT

Figure 1:
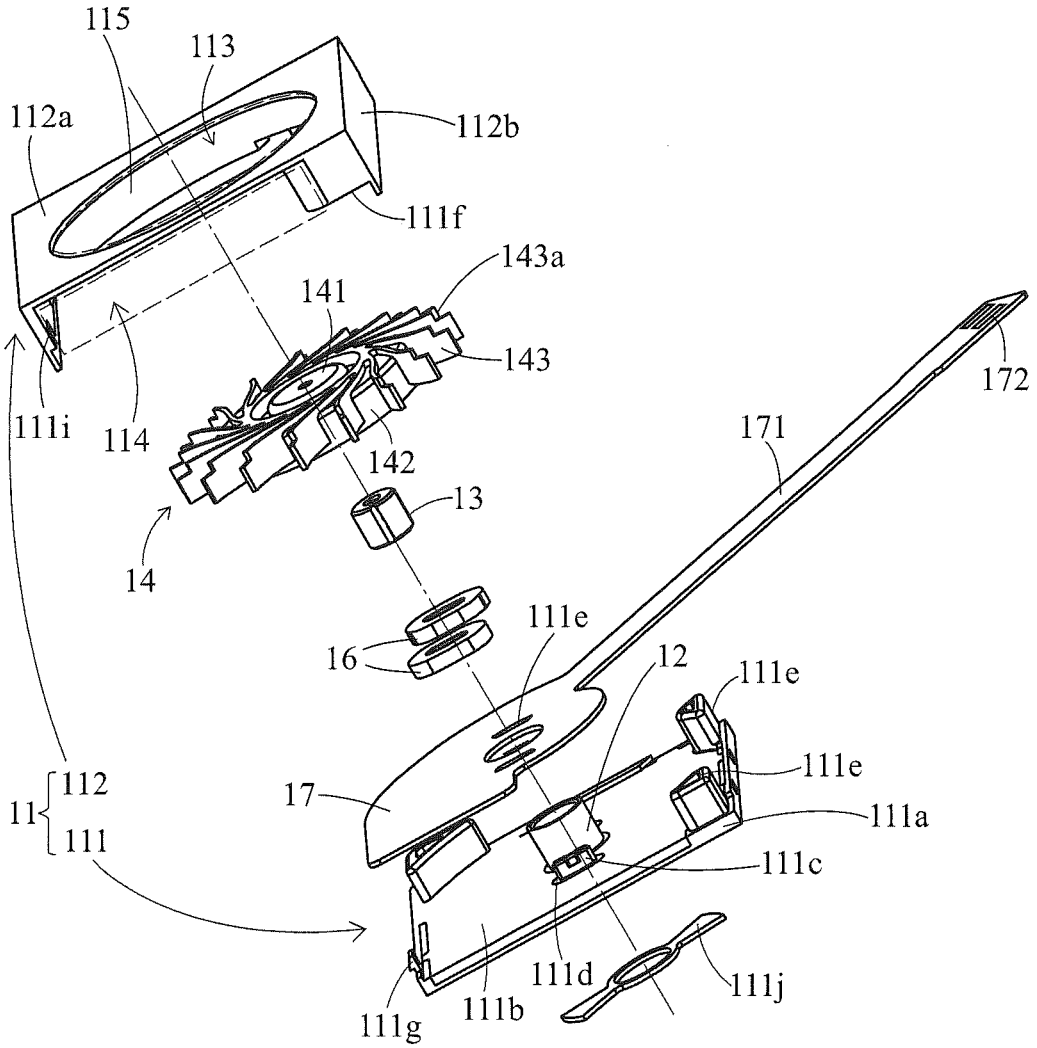
FIG. 1 is a schematic exploded view of a thin fan according to the present invention.

As shown in FIG. 1, a thin fan 1 of the present invention has a fan frame 11, a sleeve 12, a bearing 13, an impeller 14 and at least one coil 16. The fan frame 11 is formed by a base 111 and a cover 112 in combination. The cover 112 has an inlet 113 and an outlet 114. Meanwhile, the sleeve 12 is disposed on the base 111, the bearing 13 is disposed within the sleeve 12, and the impeller 14 is disposed within the fan frame 11.

Figure 2:
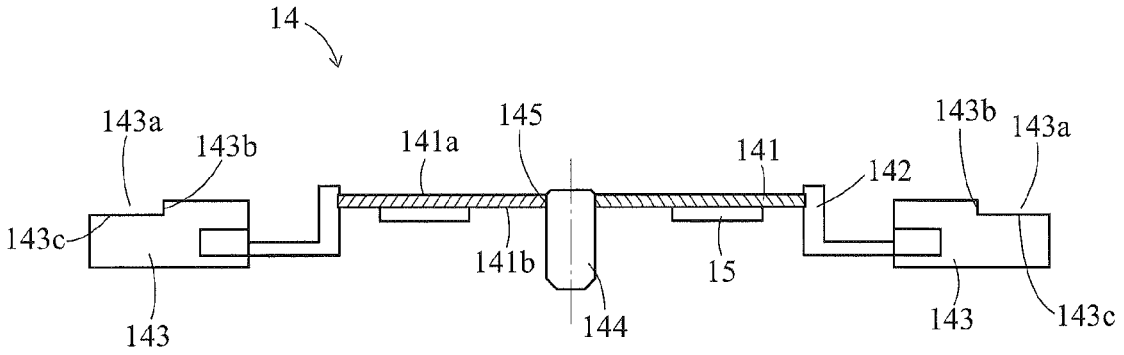
FIG. 2 is a schematic structural view of an impeller of the thin fan according to the present invention.

With reference to FIG. 2, the impeller 14 comprises a metal housing 141, a joining portion 142, a plurality of blades 143 and a shaft 144. As shown, the metal housing 141 comprises a first surface 141*a* and a second surface 141*b* opposite the first surface 141*a* in an axial direction, and is formed with an opening 145 extending through the first surface 141*a* and the second surface 141*b*. The joining portion 142 is injection molded with the metal housing 141. The blades 143 are integrated with the joining portion 142 by injection molding and disposed around a periphery of the joining portion 142.

Figure 3:
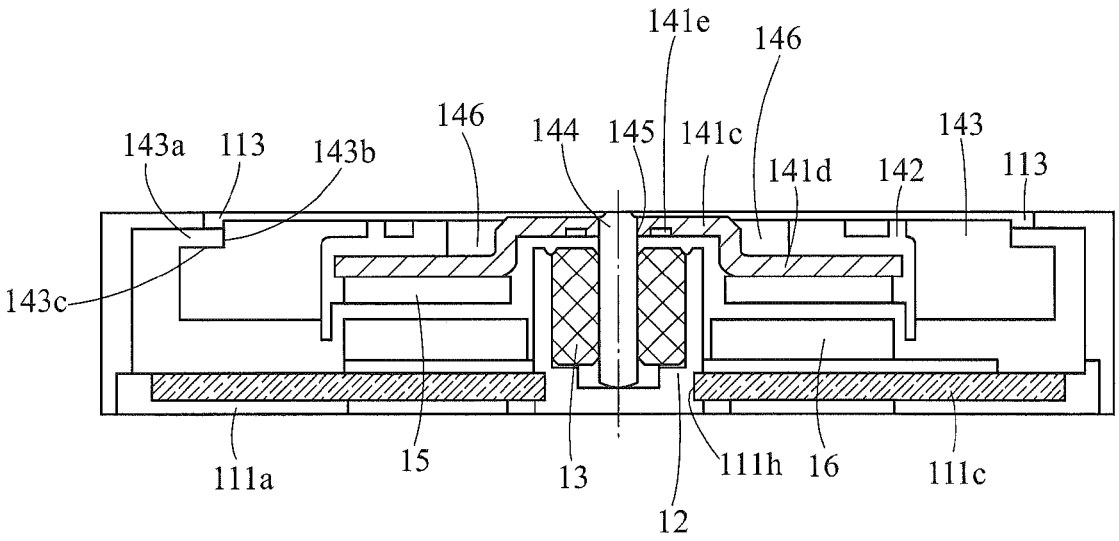
FIG. 3 is a cross-sectional view of the thin fan according to the present invention.

Further, with reference to FIG. 3, the shaft 144 passes through the bearing 13 and extends into the opening 145. The shaft 144 is welded with the metal housing 141 at a position where the opening 145 adjoins the first surface 141*a*. Furthermore, a magnetic element 15 is disposed within the metal housing 141. At least one coil 16 is disposed corresponding to the magnetic element 15 in the axial direction.

Furthermore, a laser radiates the metal housing 141 and the shaft 144 at the position where the opening 145 adjoins the first surface 141*a* to fuse and weld a surface of the metal housing 141 and a surface of the shaft 144 together. With this structure, the metal housing 141 only needs to have a very small thickness to be firmly joined with the shaft 144. Furthermore, this structure will not reduce a height of the sleeve and allows for the use of a bearing with a large height. This increases the amount of lubricant in the bearing, so the service life of the bearing can be significantly prolonged. The material of the metal housing 141 is preferred to be SUS430,while the material of the shaft 144 is preferred to be SUS420. The metal housing 141 and the shaft 144 have melting points close to each other.

FIG. 3 illustrates a metal housing 141 comprises a convex portion 141*c* and an extended portion 141*d* around the convex portion 141*c*. The joining portion 142 is integrated with the blades 143 by injection molding at a periphery of the extended portion 141*d*. The joining portion 142 and at least a part of the blades 143 are adapted to extend to an upper edge of the extended portion 141*d*. Through the disposition of the convex portion and the extended portion, the sleeve can extend into a concave portion formed under the convex portion to prolong the height of the sleeve. On the other hand, apart from the blades disposed at the periphery of the extended portion, some of the blades may also extend to the upper edge of the extended portion of the metal housing, and this can further increase the height of the blades so that the air flow disturbed by the blades is increased to enhance the heat dissipating effect.

In detail, at least one gap 146 may exist between the joining portion 142 and the convex portion 141*c*. The gap 146 is filled with a balance material to maintain the balance and stability of the impeller 14 during operation and especially, when operating at a high speed. With limited space, the balance material is accommodated in the pre-existing gap without the need of providing an additional space that would occupy the height of the structure. The metal housing 141 has a disc shape. One end of the joining portion 142 is connected to a periphery of the metal housing 141 and the other end is connected to the blades 143. Meanwhile, the first surface 141*a* of the metal housing 141 corresponds to the direction of the inlet 113. The second surface 141*b* of the metal housing 141 corresponds to the direction of the sleeve 12 and has an annular recess 141*e*, which is filled with an oil repellent agent to prevent the lubricant in the sleeve 12 from overflowing.

Hereinafter, the fan frame 11 of the thin fan 1 of the present invention as well as the base 111 and the cover 112 comprised in the fan frame 11 will be firstly described in detail.

As shown in FIG. 1, the base 111 of the fan frame 11 has at least one plastic portion 111*a* and at least one metal portion 111*b*. The metal portion 111*b* comprises at least one non-magnetic metal 111*i*, and the plastic portion 111*a* is integrated with the non-magnetic metal 111*i* by injection molding. The vibration caused by the motor or the impeller rotating at a high speed will cause a resonance effect in the structure of the thin fan itself, which results in a loud noise. However, by overmolding the plastic portion and the metal portion into a bottom plate of the thin fan, the structure of the thin fan can be enhanced and the noises generated by resonance of the structure can be avoided.

In detail, the base 111 of the fan frame 11 comprised in the thin fan 1 of the present invention is implemented in the following two ways.

Figure 4:
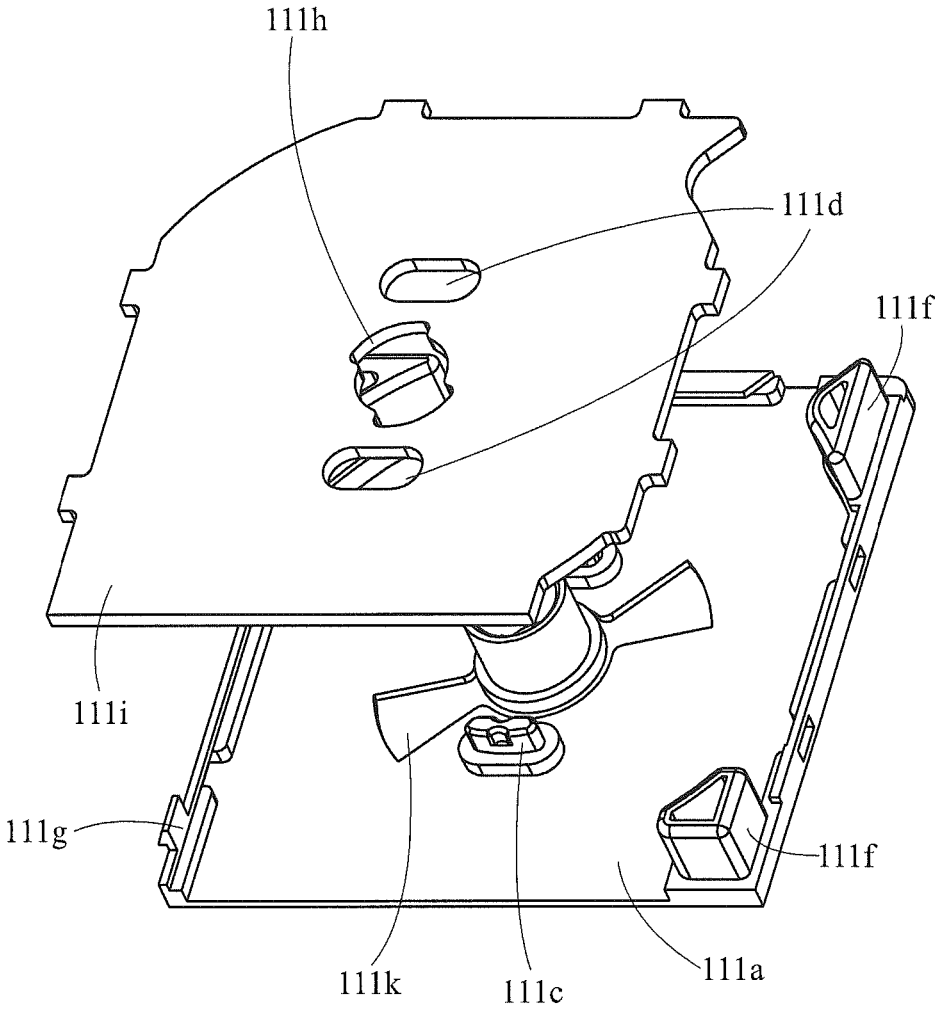
FIG. 4 is a schematic view showing a first embodiment of a base of the thin fan according to the present invention.

In a first embodiment as shown in FIG. 4, the plastic portion 111*a* of the base 111 covers a lower surface of the non-magnetic metal 111*i* from bottom to top by injection molding, thereby, constituting the bottom of the base 111. A ratio of a thickness of the plastic portion 111*a* to a thickness of the non-magnetic metal 1111 is preferred to range from 1:1 and 1:4 to achieve the efficacy of both reducing the resonance effect and increasing the structural strength. Furthermore, the plastic portion 111*a* comprises at least one protruding portion 111*c* extending into the coil 16 to position the coil 16, and correspondingly, the non-magnetic metal 111*i* has at least one positioning hole 111*d* which allows the protruding portion 111*c* to pass therethrough; i.e., the coil 16 is directly disposed around a periphery of the protruding portion 111*c* made of a plastic rather than being wound around a silicon steel or an iron core like a conventional coil. With this structure, the height of the fan can be further reduced.

Figure 5:
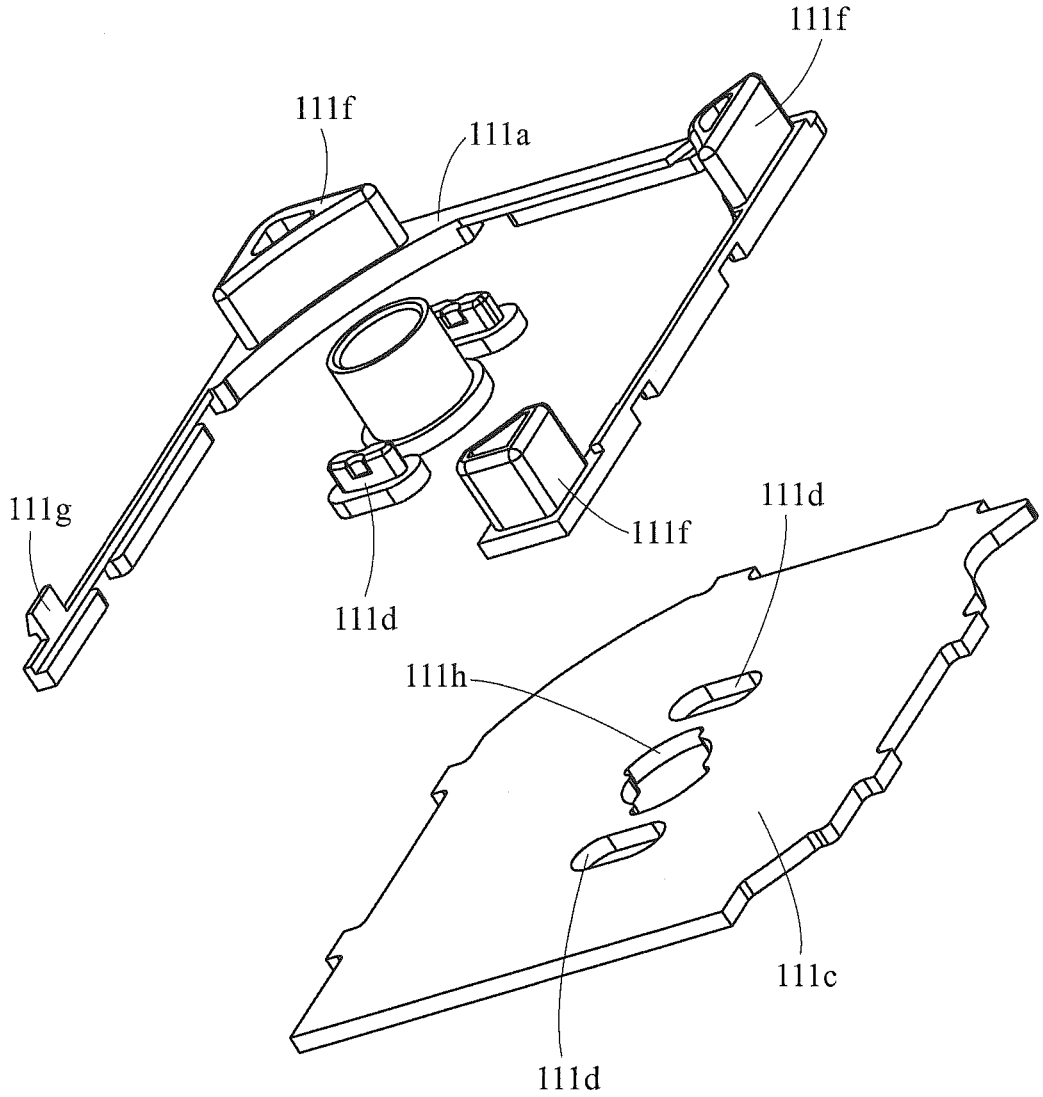
FIG. 5 is a schematic view showing a second embodiment of the base of the thin fan according to the present invention.

A second embodiment as shown in FIG. 5 differs from the first embodiment in that the bottom of the base 111 is formed by the non-magnetic metal 111*i*, and at least a part of the plastic portion 111*a* is disposed at a periphery of the non-magnetic metal 111*i;* and in more detail, at least a part of the plastic portion 111*a* covers the non-magnetic metal 111*i* around the periphery of the non-magnetic metal 111*i*. In this way, the aforesaid efficacy of both reducing the resonance effect and increasing the structural strength can also be achieved; and because the bottom of the base is formed by the non-magnetic metal, the thickness of the plastic portion is eliminated and the overall height of the fan can be further reduced.

With reference to both FIGS. 1 and 2, the metal portion 111*b* of the base 111 further comprises at least one magnetic metal 111*j* disposed at the bottom of the base 111. The magnetic metal 111*j* can produce a magnetic force with the magnetic element 15 within the metal housing 141 to position the impeller 14 accurately. As shown in FIG. 4, the plastic portion 111*a* may further comprise at least one recess 111*k* for embedding and fixing the at least one magnetic metal 111*j* therein. The magnetic metal of this structure does not need to be attached to the bottom of the plastic portion 111*a*, but is directly embedded into the plastic portion 111*a* to avoid the additional thickness of the magnetic metal 111*j*.

The material of the sleeve 12 is a plastic, and the sleeve 12 and the plastic portion 111*a* of the base 111 are integrated with the non-magnetic metal 111*i* by injection molding. Furthermore, the material of the non-magnetic metal 111*i* is preferred to be SUS301 or SUS304, and the material of the magnetic metal 111*j* is preferred to be silicon steel.

Figure 6:
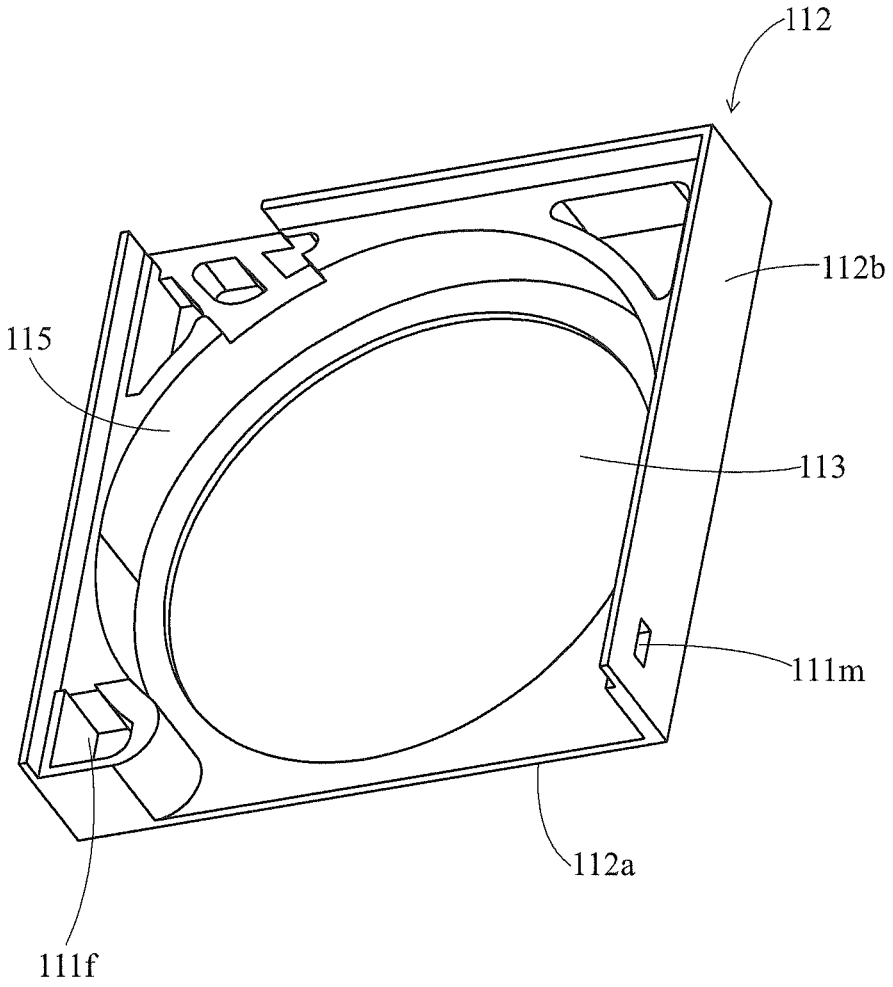
FIG. 6 is a schematic view of a cover of the thin fan according to the present invention.

As shown in FIG. 6, the cover 112 joined with the base 111 has a top wall 112*a* and at least one side wall 112*b* which surrounds the top wall 112*a*. As shown, the inlet 113 is disposed on the top wall 112*a*, and the outlet 114 is disposed on the side wall 112*b*. A center of the inlet 113 and a center of the top wall 112*a* of the cover 112 are not overlapping. The center of the inlet 113 is directed towards the direction of the outlet 114. The cover 112 further comprises at least one flow channel structure 115 extending from the top wall 112*a* towards the base 111. The flow channel structure 115 is disposed at a periphery of the impeller 14.

Accordingly, by means of at least one convex portion 111*e* that extends in the axial direction on the base 111 and at least one slot 111*f* disposed on the cover 112 and corresponding to the at least one convex portion 111*e*, the base 111 and the cover 112 can be combined together by embedding the convex portion 111*e* into the slot 111*f*. The slot 111*f* is formed on the flow channel structure 115. Furthermore, the base 111 may also have at least one snap 111*g* disposed thereon and, correspondingly, the cover 112 may also have at least one aperture 111*m* formed therein. In this way, after the base 111 and the cover 112 are combined together, the snap 111*g* can be mated with the aperture 111*m* to enhance the fixing relationship between the base 111 and the cover 112.

Next, the fixing relationship between the sleeve 12 and the base 111 will be described as follows.

First, with reference to FIG. 3, when the sleeve 12 is made of a plastic, the sleeve 12, together with the plastic portion 111*a* of the base 111, can be integrated with the non-magnetic metal 111*i* by injection molding so that the sleeve 12 is fixed to the base 111.

Figure 7:
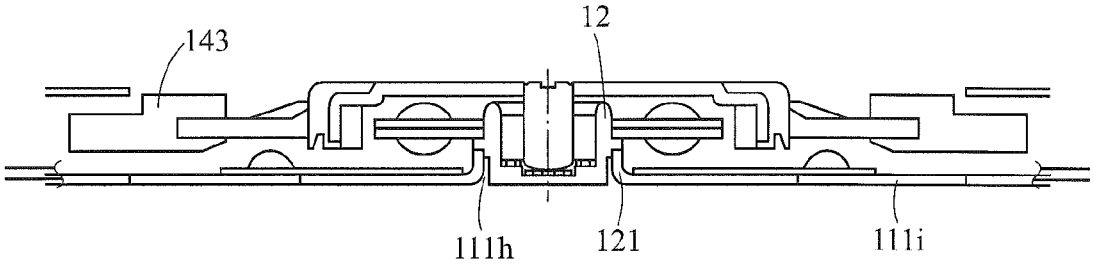
FIG. 7 is a schematic view showing how a non-magnetic metal and a sleeve are joined in the thin fan according to the present invention.
Figure 8:
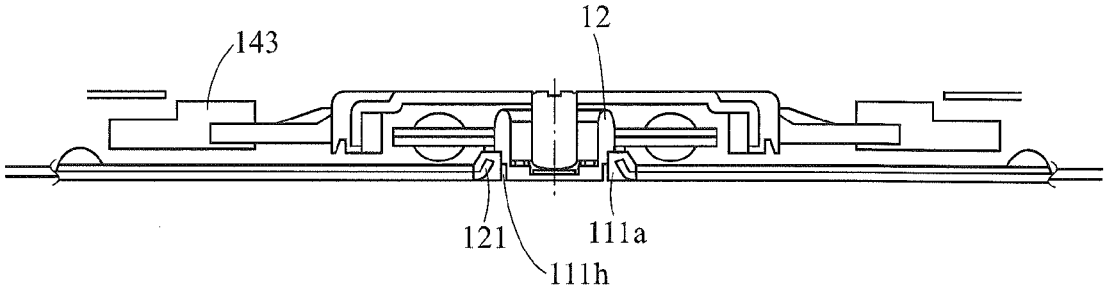
FIG. 8 is another schematic view showing how the non-magnetic metal and the sleeve are joined in the thin fan according to the present invention.

Next, in reference to FIGS. 7 and 8, when the sleeve 12 is a metal sleeve, the non-magnetic metal 111*i* of the base 111 may further comprise a through hole 111*h* for positioning the sleeve 12. In detail, in an embodiment as shown in FIG. 7, the non-magnetic metal 111*i* around the through hole 111*h* has a ring-shaped protrusion 121 which clips to the sleeve 12 directly. Furthermore, in an embodiment as shown in FIG. 8, the non-magnetic metal 111*i* around the through hole 111*h* has a ring-shaped protrusion 121; the ring-shaped protrusion 121 and the sleeve 12 are integrated together by the plastic portion 111*a*. It is also possible to use a laser to radiate a periphery of the through hole 111*h* to fuse and weld a surface of the metal sleeve 12 and a surface of the non-magnetic metal 111*i* with each other, thereby, fixing the sleeve 12 to the base 111. It is also possible to fuse the surface of one of the metal sleeves 12 and the non-magnetic metal 111*i* to weld the metal sleeve 12 and the non-magnetic metal 111*i* together.

Therefore, whether the sleeve 12 is made of a plastic or a metal, the sleeve 12 can be fixed to the base 111 in the aforesaid ways, but the present invention is not limited thereto.

As shown in FIG. 2 and FIG. 3, each of the blades 143 of the thin fan 1 of the present invention further comprises a notch 143*a*, which has a side edge 143*b* and a lower edge 143*c*. The lower edge 143*c* extends under the top wall 112*a* of the cover 112 to prevent the impeller 14 from falling off the inlet 113. The side edge 143*b* extends into the inlet 113, so the height of the blades can be extended as much as possible to increase the air flow without increasing the overall height of the fan. A height of the fan frame 11 is preferred to be less than 4 mm. A height of the sleeve 12 is larger than 75% of the height of the fan frame 11; that is, the fan can be made very thin without reducing the height of the sleeve and the height of the bearing.

With reference to FIG. 1 again, the thin fan 1 further comprises a flexible substrate 17 disposed between the base 111 and the coil 16. A surface of the flexible substrate 17 has an isolation layer (not shown), which can be directly formed on the non-magnetic metal 111*i*. The isolation layer is formed on the surface of the non-magnetic metal 111*i* through electrophoresis or electroplating. The coil 16 is adapted to be disposed on a surface of the isolation layer. The flexible substrate 17 can be made very thin, and can be directly stuck to the base 111. In contrast, the conventional rigid printed circuit board (PCB) has a large thickness and is disposed on the base through the use of an additional fixing element, so both the cost and the height of the fan are increased.

The flexible substrate 17 further comprises at least one flat cable 171 extending in a plate form. One end of the flat cable 171 connects the flexible substrate 17 and the other end comprises a finger structure 172. Furthermore, in a preferred implementation of the present invention, the magnetic element 15 disposed within the impeller 14 is disposed corresponding to the coil 16 in the axial direction; the magnetic element 15 is flat ring-shaped and is attached to the lower edge of the metal housing 141; and the material of the magnetic element 15 is Rubidium Iron Boron.

Figure 9:
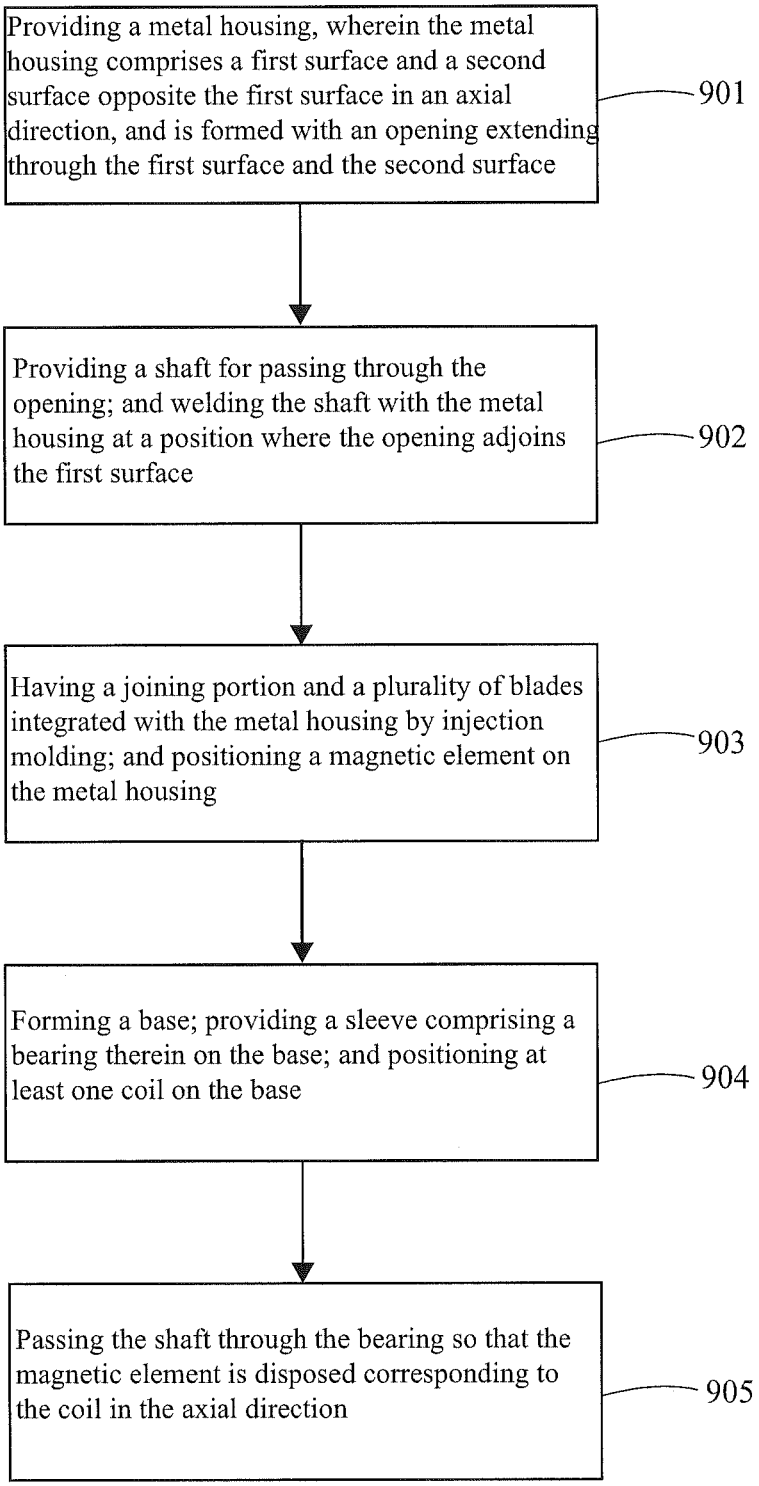
FIG. 9 is a flowchart diagram of a manufacturing method of a thin fan according to the present invention.

As shown in FIG. 9, a manufacturing method of a thin fan 1 according to the present invention will be described as follows.

First, as shown in step 901, a metal housing 141 is provided. The metal housing 141 comprises a first surface 141*a* and a second surface 141*b* opposite the first surface 141*a* in an axial direction, and is formed with an opening 145 extending through the first surface 141*a* and the second surface 141*b*. Then, as shown in step 902, a shaft 144 is provided for passing through the opening 145. The shaft 144 and the metal housing 141 are welded at a position where the opening 145 adjoins the first surface 141*a*. As shown in step 903, a joining portion 142 and a plurality of blades 143 are integrated with the metal housing 141 by injection molding, and a magnetic element 15 is positioned on the metal housing 141. As shown in step 904, a base 111 is formed, a sleeve 12 comprising a bearing 13 therein is provided on the base 111, and at least one coil 16 is positioned on the base 111. Finally, as shown in step 905, the shaft 144 passes through the bearing 13 so that the magnetic element 15 is disposed corresponding to the coil 16 in the axial direction. In this way, the manufacturing of the thin fan 1 of the present invention can be completed.

Furthermore, step 902 further comprises the following: radiating the position where the opening 145 adjoins the first surface 141*a* by a laser to fuse and weld a surface of the metal housing 141 and a surface of the shaft 144 with each other. The step of forming the base 111 in the step 904 further comprises the following: providing at least one non-magnetic metal 111*i;* having at least one plastic portion 111*a* integrated with the non-magnetic metal 111*i* by injection molding; and attaching a magnetic metal 111*j* onto the plastic portion 111*a* or the non-magnetic metal 111*i*.

According to the above descriptions, the metal housing 141 of the impeller 14 of the thin fan 1 according to the present invention is joined with the surface of the shaft 144 through welding, so the shaft and the metal housing can be combined together firmly without reducing the height of the sleeve, but at the same time effectively reducing the height of the bearing and the fan. Meanwhile, the base 111 comprises at least one plastic portion 111*a* and at least one metal portion 111*b*. The metal portion 111*b* comprises at least one non-magnetic metal 1111, and the plastic portion 111*a* is integrated with the non-magnetic metal 111*i* by injection molding. Therefore, the structure of the base 111 thus formed can not only help to increase the rotating speed of the impeller 14 to dissipate the heat effectively, but also reduce the noise caused by resonance of the structure to avoid discomfort of the user possibly caused by the noise.

The above disclosure is related to the detailed technical contents and inventive features thereof. People skilled in this field may proceed with a variety of modifications and replacements based on the disclosures and suggestions of the invention as described without departing from the characteristics thereof. Nevertheless, although such modifications and replacements are not fully disclosed in the above descriptions, they have substantially been covered in the following claims as appended.

What is claimed is:

1. A thin fan, comprising:

a fan frame, having a base and a cover connected to the base, and comprising an inlet and an outlet;

a sleeve, being disposed on the base;

a bearing, being disposed within the sleeve;

an impeller, being disposed within the fan frame, and comprising:

a metal housing, having a first surface and a second surface opposite the first surface in an axial direction, and being formed with an opening extending through the first surface and the second surface;

a joining portion, being injection molded with the metal housing;

a plurality of blades, being integrated with the joining portion by injection molding and disposed around a periphery of the joining portion; and a shaft, passing through the bearing and extending into the opening, wherein the shaft is welded with the metal housing at a position where the opening adjoins the first surface;

a magnetic element, being disposed within the metal housing; and at least one coil, being disposed corresponding to the magnetic element in the axial direction;

wherein the base further comprises at least one plastic portion having at least one protruding portion which is integrally molded with the base and is extending into the coil to position the coil, and the coil is directly disposed around a periphery of the protruding portion.

2. The thin fan as claimed in claim 1, wherein a laser radiates the position where the opening adjoins the first surface, so as to fuse and weld a surface of the metal housing and/or a surface of the shaft with each other, wherein the metal housing and the shaft have melting points close to each other.

3. The thin fan as claimed in claim 1, wherein the metal housing comprises a convex portion and an extended portion around the convex portion, the joining portion is integrated with the plurality of blades by injection molding at a periphery of the extended portion, and the joining portion and at least a part of the plurality of blades extend to an upper edge of the extended portion, wherein at least one gap exists between the joining portion and the convex portion, and the gap is filled with a balance material.

4. The thin fan as claimed in claim 1, wherein the metal housing has a disc shape, one end of the joining portion is connected to a periphery of the metal housing and the other end is connected to the plurality of blades.

5. The thin fan as claimed in claim 1, wherein the first surface corresponds to the direction of the inlet, the second surface corresponds to the direction of the sleeve, and the second surface has an annular recess and the annular recess is filled with an oil repellent agent.

6. The thin fan as claimed in claim 1, wherein the base further comprises at least one metal portion.

7. The thin fan as claimed in claim 6, wherein the metal portion comprises at least one non-magnetic metal and the plastic portion is integrated with the non-magnetic metal by injection molding.

8. The thin fan as claimed in claim 7, wherein the plastic portion covers a lower surface of the non-magnetic metal to constitute a bottom of the base, and a ratio of a thickness of the plastic portion to a thickness of the non-magnetic metal is between 1:1 and 1:4.

9. The thin fan as claimed in claim 8, wherein the non-magnetic metal comprises at least one positioning hole which allows the protruding portion to pass therethrough.

10. The thin fan as claimed in claim 7, wherein the metal portion further comprises at least one magnetic metal for producing a magnetic force with the magnetic element, and the plastic portion comprises at least one recess for embedding the at least one magnetic metal therein.

11. The thin fan as claimed in claim 7, wherein the material of the sleeve is a plastic and the sleeve and the plastic portion of the base are integrated with the non-magnetic metal by injection molding.

12. The thin fan as claimed in claim 7, wherein the non-magnetic metal of the base comprises a through hole for positioning the sleeve.

13. The thin fan as claimed in claim 7, further comprising an isolation layer directly formed on the surface of the non-magnetic metal, wherein the isolation layer is formed on the surface of the non-magnetic metal through electrophoresis or electroplating, and the at least one coil is disposed on a surface of the isolation layer.

14. The thin fan as claimed in claim 1, wherein the cover comprises a top wall and at least one side wall surrounding the top wall, the inlet is disposed on the top wall and the outlet is disposed on the side wall, wherein a center of the inlet and a center of the top wall of the cover are not overlapped, and the center of the inlet is biased toward the direction of the outlet.

15. The thin fan as claimed in claim 14, wherein the cover further comprises at least one flow channel structure extending from the top wall toward the base, and the flow channel structure is disposed at a periphery of the impeller, wherein the base comprises at least one convex portion extending in the axial direction, the cover comprises at least one slot corresponding to the convex portion, the base and the cover are combined together via the convex portion embedded in the slot, the slot is formed on the flow channel structure, and the base comprises at least one snap, and the cover comprises at least one aperture corresponding to the snap.

16. The thin fan as claimed in claim 14, wherein each of the blades further comprises a notch, the notch comprises a side edge and a lower edge, the lower edge extends under the top wall of the cover and the side edge extends into the inlet to prevent the impeller from falling off from the inlet.

17. The thin fan as claimed in claim 1, further comprising at least one flat cable extending in a plate form and a flexible substrate which is disposed between the base and the coil, wherein a surface of the flexible substrate comprises an isolation layer, the coil is disposed on the isolation layer, one end of the flat cable connects the flexible substrate and the other end comprises connectors, and the magnetic element is flat ring-shaped and is attached to the lower edge of the metal housing.

18. The thin fan as claimed in claim 1, wherein a height of the fan frame is less than 4 mm, and a height of the sleeve is larger than 75% of the height of the fan frame.

19. A manufacturing method of a thin fan, comprising:

providing a metal housing, wherein the metal housing comprises a first surface and a second surface opposite the first surface in an axial direction, and is formed with an opening extending through the first surface and the second surface;

providing a shaft for passing through the opening;

welding the shaft with the metal housing at a position where the opening adjoins the first surface;

having a joining portion and a plurality of blades integrated with the metal housing by injection molding;

positioning a magnetic element on the metal housing;

forming a base comprising at least one plastic portion having at least one protruding portion which is integrally molded with the base;

providing a sleeve disposed on the base, wherein the sleeve comprises a bearing;

positioning at least one coil on the base such that the coil is directly disposed around a periphery of the protruding portion, which the protruding portion extends into the coil to position the coil; and passing the shaft through the bearing so that the magnetic element is disposed opposite the coil in the axial direction.

20. The manufacturing method as claimed in claim 19, wherein the step of welding the shaft with the metal housing at a position where the opening adjoins the first surface further comprises:

radiating the position where the opening adjoins the first surface by a laser, so as to fuse and weld a surface of the metal housing and/or a surface of the shaft with each other.

21. The manufacturing method as claimed in claim 20, wherein the step of forming the base further comprises:

providing at least one non-magnetic metal; and integrating the at least one plastic portion with the non-magnetic metal by infection molding.

22. The manufacturing method as claimed in claim 21, further comprising a step of attaching a magnetic metal on the plastic portion.

* * * * *